US011655712B2

(12) United States Patent
Tarada

(10) Patent No.: US 11,655,712 B2
(45) Date of Patent: May 23, 2023

(54) OPTIMISED TUNNEL VENTILATION DEVICE

(71) Applicant: Mosen Ltd, Forest Row (GB)

(72) Inventor: Fathi Tarada, East Grinstead (GB)

(73) Assignee: Mosen LTD, East Sussex (GB)

( * ) Notice: Subject to any disclaimer, the term of this patent is extended or adjusted under 35 U.S.C. 154(b) by 711 days.

(21) Appl. No.: 16/608,943

(22) PCT Filed: Feb. 21, 2018

(86) PCT No.: PCT/GB2018/000029
§ 371 (c)(1),
(2) Date: Oct. 28, 2019

(87) PCT Pub. No.: WO2018/203023
PCT Pub. Date: Nov. 8, 2018

(65) Prior Publication Data

US 2020/0182056 A1 Jun. 11, 2020

(30) Foreign Application Priority Data

May 4, 2017 (GB) ..... 1707147
May 10, 2017 (GB) ..... 1707467

(51) Int. Cl.

| | |
|---|---|
| ***F04D 25/08*** | (2006.01) |
| ***E21F 1/00*** | (2006.01) |
| ***F04D 29/44*** | (2006.01) |
| ***F04D 29/54*** | (2006.01) |
| ***F04D 29/60*** | (2006.01) |

(52) U.S. Cl.
CPC ..... *E21F 1/003* (2013.01); *F04D 25/08* (2013.01); *F04D 29/441* (2013.01); *F04D 29/545* (2013.01); *F04D 29/547* (2013.01); *F04D 29/602* (2013.01); *F05D 2250/52* (2013.01)

(58) Field of Classification Search
None
See application file for complete search history.

(56) References Cited

U.S. PATENT DOCUMENTS

2011/0275302 A1* 11/2011 Tarada ..... A62C 3/0221 454/166
2014/0299402 A1 10/2014 Kang
2016/0025105 A1* 1/2016 Tarada ..... E21F 1/08 454/168

FOREIGN PATENT DOCUMENTS

| | | | |
|---|---|---|---|
| AT | 375155 | B | 7/1984 |
| CN | 201826127 | U | 5/2011 |
| CN | 105090075 | A | 11/2015 |

(Continued)

OTHER PUBLICATIONS

International Search Report and Written Opinion of the ISA/EP in PCT/GB2018/000029, dated Jun. 19, 2018, 11pgs.

(Continued)

*Primary Examiner* — Michael Lebentritt
(74) *Attorney, Agent, or Firm* — Fredrikson & Byron, P.A.

(57) ABSTRACT

A ventilation device that enhances the effective longitudinal thrust of a fan assembly installed within a tunnel or other internal space. The nozzle trailing edge (6) is tilted so that it forms an angle (13) with respect to the fan centreline (7), with the surface of the nozzle throughbore being non-cylindrical in shape. The discharged flow (5) is turned away from the surrounding surfaces by a convergent-divergent bellmouth (1).

9 Claims, 4 Drawing Sheets

(56) References Cited

FOREIGN PATENT DOCUMENTS

| | | | |
|---|---|---|---|
| DE | 2509279 | A1 | 9/1976 |
| DE | 29924674 | U1 | 10/2004 |
| EP | 0410428 | A2 | 1/1991 |
| EP | 1050684 | A2 | 11/2000 |
| GB | 2465261 | A | 5/2010 |
| GB | 2479082 | A | 9/2011 |
| GB | 2509928 | A | 7/2014 |
| GB | 2512181 | A | 9/2014 |
| JP | H01237400 | A | 9/1989 |

OTHER PUBLICATIONS

Search Report under Section 17(5) of the GB Intellectual Property Office dated Nov. 6, 2017 in GB App. No. GB1707147.3, 3pgs.
Search Report under Section 17(5) of the GB Intellectual Property Office dated Nov. 10, 2017 in GB App. No. GB1707467.5, 5pgs.

* cited by examiner

OPTIMISED TUNNEL VENTILATION DEVICE

RELATED APPLICATIONS

This application is a 35 U.S.C. 371 national phase filing from International Application No. PCT/GB2018/000029, filed Feb. 21, 2018, which claims priority from Great Britain Patent Application Nos. 1707467.5, filed May 10, 2017 and 1707147.3, filed May 4, 2017, the entire contents of each application is incorporated herein by reference.

BACKGROUND OF THE INVENTION

Longitudinal ventilation by jetfans is a well-established technique for establishing airflows in tunnels and car parks, for the improvement of air quality during normal and congested operations, as well as for the control of smoke during fires.

A previous patent application number GB2512181 filed by the present Applicant describes an improved jetfan, wherein the angle made between the nozzle trailing edge and a centreline of the nozzle is not perpendicular, and wherein at least one of the nozzle throughbore edges is arranged to turn the flow away from the surrounding tunnel surfaces. That invention reduces the Coanda effect of the jet issued from the jetfan, and hence improves the energy efficiency of the tunnel ventilation.

The tilting of one of the nozzle throughbore edges to turn the flow away from the surrounding tunnel surfaces in GB2512181 has the effect that the nozzle trailing edge must be tilted through a large angle (around 30°), in order to ensure that the aerodynamic throat of the nozzle throughbore is at least equal to the fan area. Since the airflow enters the jetfan in a direction normal to the inlet nozzle plane, such a large nozzle trailing edge angle can cause the flow to separate at the nozzle inlet, causing additional pressure losses.

JP-A-H1-237400 discloses a jetfan with an undercut on the lower side of the cylindrical casing, to encourage the discharged air to turn away from the tunnel soffit. However, since the trailing nozzle trailing edge is shaped as an ellipse, it is not feasible to attach commercially available bellmouths on the nozzle trailing edges, which in turn implies significant pressure losses through the jetfan.

The Applicant believes that there remains scope to improve the energy efficiency of longitudinal tunnel ventilation systems.

SUMMARY OF THE INVENTION

According to one aspect of the invention, there is provided a fan assembly for installation in an internal space to provide ventilation in the internal space, the fan assembly comprising:

a fan rotor for generating a ventilating flow, the inflow into the fan rotor being substantially parallel to the outflow from the fan rotor;

a nozzle throughbore having an edge which, in use, is in proximity to the surrounding surface on which the fan assembly is installed;

wherein:

the nozzle has a trailing edge at the distal end from the fan;

the fan assembly is arranged or arrangeable such that a ventilating flow generated by the fan will pass through the nozzle before exiting the assembly to enter a space to be ventilated;

the angle made between the nozzle trailing edge and a centreline of the fan is not perpendicular;

the surface of the nozzle throughbore is non-cylindrical; and the nozzle throughbore edge is not arranged to direct the flow away from the surrounding surface when air is supplied from the fan rotor.

Preferably, the nozzle throughbore edge is substantially parallel to the centreline of the fan.

Preferably the edge of the nozzle throughbore at the distal end from the fan forms a circle.

Preferably two nozzles are provided, one installed on each side of the fan.

Preferably the angle between the trailing edge and a line normal to the centreline of the fan is within the range of 5 to 60 degrees.

The invention provides a solution to the technical issue of how to turn the flow from a jetfan away from the surrounding tunnel surfaces and hence achieve greater in-tunnel aerodynamic thrust, without increasing the pressure drop through the jetfan.

The turning of the flow discharged into the tunnel is partially achieved through tilting the nozzle trailing edge. The jetfan is arranged with the longer side of the throughbore closer to the surrounding tunnel surface than the shorter side of the throughbore. The tilting of the nozzle trailing edge thus serves to turn the flow away from the surrounding tunnel surface.

Compared to GB2512181, this present invention allows for a larger cross-sectional area through the throughbore, since the area is no longer restricted by an angled throughbore edge. In addition, smaller tilt angles can be selected for the inlet trailing edge, in order to reduce the likelihood and extent of any inlet flow separation. The power consumption of the jetfan is thus significantly reduced.

According to another aspect of the invention, there is provided a fan assembly for installation in an internal space to provide ventilation in the internal space, the fan assembly comprising:

a fan rotor for generating a ventilating flow, the inflow into the fan rotor being substantially parallel to the outflow from the fan rotor;

a nozzle which has a trailing edge at the distal end from the fan;

a bellmouth is attached to the nozzle trailing edge;

wherein the fan assembly is arranged or arrangeable such that a ventilating flow generated by the fan will pass through the nozzle throughbore before exiting the assembly to enter the internal space to be ventilated; and the angle made between the nozzle trailing edge and a centreline of the fan is not perpendicular;

and wherein:

the cross-sectional area of the bellmouth throughbore decreases from the location of its attachment to the nozzle in the direction away from the fan, to a minimum cross-sectional area.

The bellmouth described in this invention is attached to the trailing edge of a nozzle, which is inclined such that the trailing edge is not perpendicular to the centreline of the fan.

The bellmouth is preferably arranged to be rotationally symmetrical about its own central axis. Such a geometry is readily manufactured using standard spinning production techniques.

The bellmouth described in this invention improves thrust and reduces power consumption through two effects.

Firstly, it can ensure smooth flow along the shortest edge of the nozzle throughbore inlet, thereby avoiding flow separation.

Secondly, the bellmouth deflects the jet discharged from the longest edge of the nozzle away from the surrounding tunnel surfaces, which reduces the Coanda effect and enhances the in-tunnel thrust.

The first effect described above can preferably be achieved by arranging the bellmouth throughbore to be substantially parallel to the shortest edge of the nozzle throughbore, at its point of attachment to the nozzle. This geometric arrangement implies that the bellmouth throughbore has a convergent cross-sectional area at its point of attachment to the nozzle, in a direction away from the fan. The bellmouth throughbore can therefore converge down to a minimum cross-sectional area, whose value is preferably selected with reference to the fan cross-sectional area, so as not to choke the inlet or outlet flow.

Beyond the minimum bellmouth cross-sectional area, the bellmouth may be arranged in a conventional manner, preferably with a circular or an elliptical-shaped arc increasing the cross-sectional area in the direction away from the fan.

Contrary to GB2512181, which teaches that the turning of the flow can only be achieved by angling of a throughbore edge, the present invention relies upon the tilting of the nozzle trailing edge and the turning of the discharged flow by a bellmouth. The Applicant's Computational Fluid Dynamics calculations have confirmed that adequate turning of the flow into a tunnel can thereby be achieved.

The present invention has an advantage over GB2512181 in that any length of nozzle can be selected, to suit acoustic silencing requirements. The present invention is also simpler and cheaper to manufacture than GB2512181, because no angling of a throughbore edge is required. Less sheet metal may be required for production of the present invention compared to GB2512181, because there is less in-plane curvature in the developed flat patterns.

Contrary to the teaching of JP-A-H1-237400, the present invention does not use a throughbore surface that is cylindrical in shape. This allows better matching of the nozzles to bellmouths.

By using trailing edges in the shape of a circle, circular bellmouths can be attached to the nozzle inlet. Such bellmouths can be readily manufactured using spinning production techniques.

The nozzles described in the invention can typically be used for acoustic silencing, as well as for turning the discharged flow away from the tunnel surrounding surfaces.

BRIEF DESCRIPTION OF THE DRAWINGS

A number of preferred embodiments of the present invention will now be described by way of example only, and with reference to the accompanying drawings, in which.

Like reference numerals are used for like components throughout the figures.

DETAILED DESCRIPTION OF EMBODIMENTS OF THE INVENTION

Figure 1:
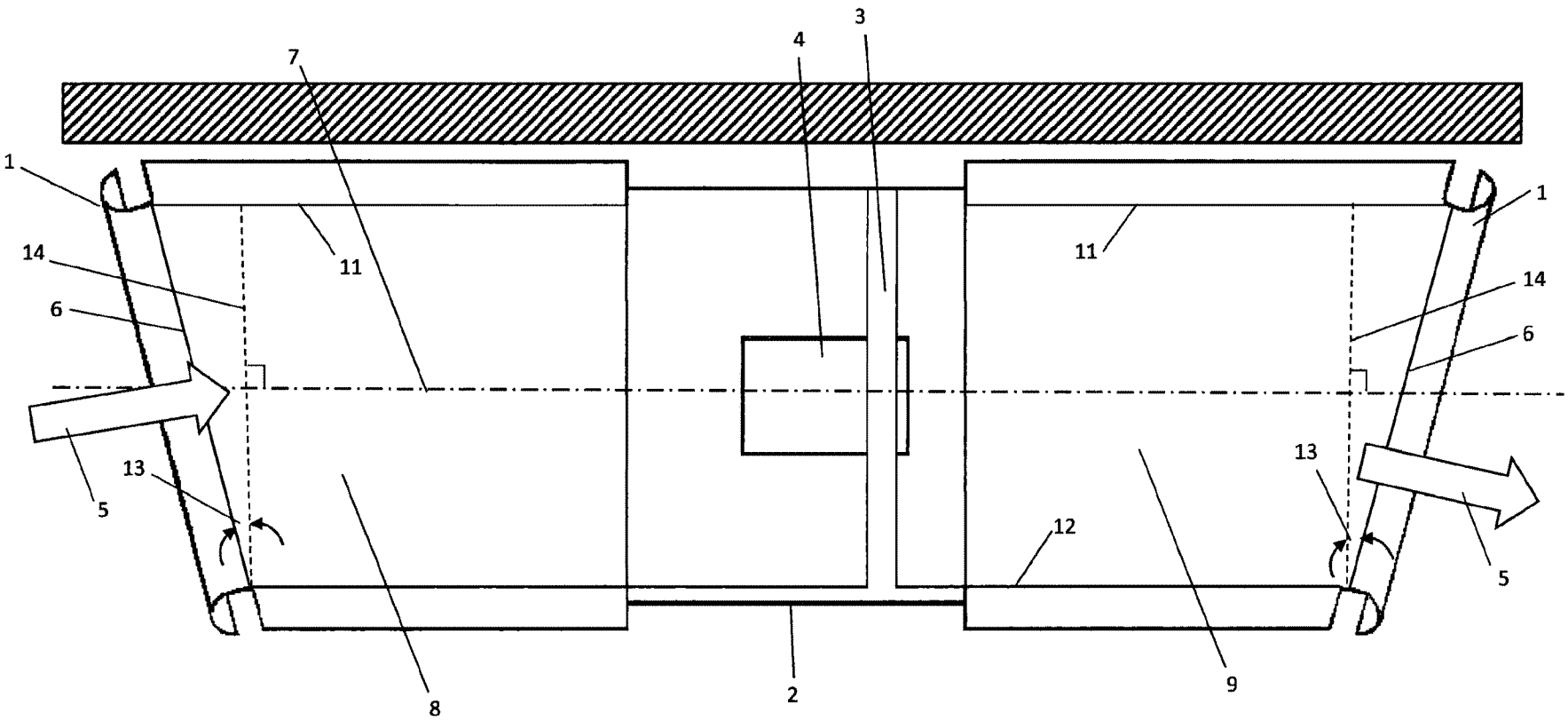
FIG. 1 shows a vertical section through an embodiment of a ventilation apparatus with nozzles as described in this invention installed on both sides of a fan.

Referring to FIG. 1, this shows a sectional side view of an embodiment of the present invention within a bidirectional ventilation apparatus installed underneath a tunnel soffit, which is designed to operate in a fully reversible manner.

In this embodiment, a fan assembly comprising a fan rotor (3) driven by a motor (4) is installed within a fan housing (2). The fan rotor (3) is mounted along the fan centreline (7).

Airflow (5) enters the fan rotor (3) through a bellmouth (1) and an inlet nozzle throughbore (8), before being discharged thorough an outlet nozzle throughbore (9) and a bellmouth (1). The inlet and outlet trailing edges of the nozzle (6) are tilted at an angle (13) with respect to the normal to the fan centreline (7). The discharged airflow is turned by the upper surface of the bellmouth (1) in a direction away from the tunnel surfaces, hence reducing the Coanda effect.

Preferably, the angle (13) is between 5 degrees and 60 degrees. Preferably still, the angle (13) is approximately 25 degrees.

A larger geometric throat (14) can be arranged at both the inlet and discharge sides of the nozzle, by tilting the nozzle trailing edge (6) by the angle (13) between the normal to the throughbore (14) and the trailing edge (6). The trailing edge (6) can thereby increase in length.

Figure 2:
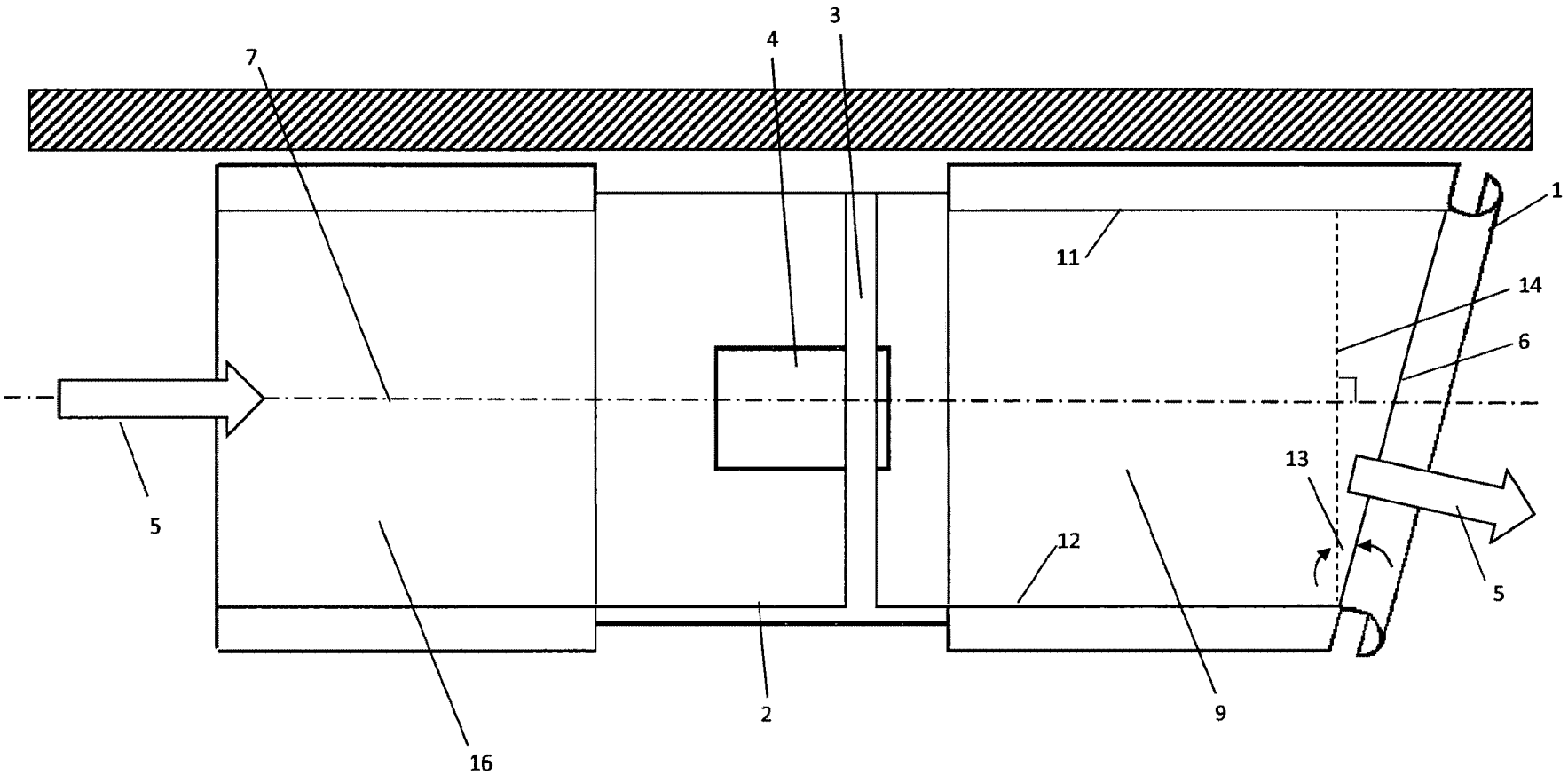
FIG. 2 shows an embodiment of a ventilation apparatus with a nozzle as described in this invention installed on one side of a fan.

We refer now to FIG. 2, which shows a side view of a particular embodiment of this invention which would normally (but not exclusively) be operated in a unidirectional manner.

In this embodiment, the indicated airflow direction is from left to right, i.e. the airflow (5) enters into a conventional nozzle (16) first, prior to being accelerated by the fan rotor (3) into a shaped nozzle with an outlet throughbore (9). The discharged flow is turned by the upper surface of the bellmouth (1). The bellmouth (1) is installed at an angle (13) with respect to the normal to the fan centreline (7), such that in use, the discharged air flows away from the surrounding tunnel surfaces.

In FIG. 2, the flow direction can if necessary be reversed by running the fan rotor in the opposite direction. Due to the increased Coanda effect, a reduction of the in-tunnel aerodynamic thrust can be expected in the reverse flow direction (i.e. from right to left) in the embodiment described in FIG. 2.

Figure 3:
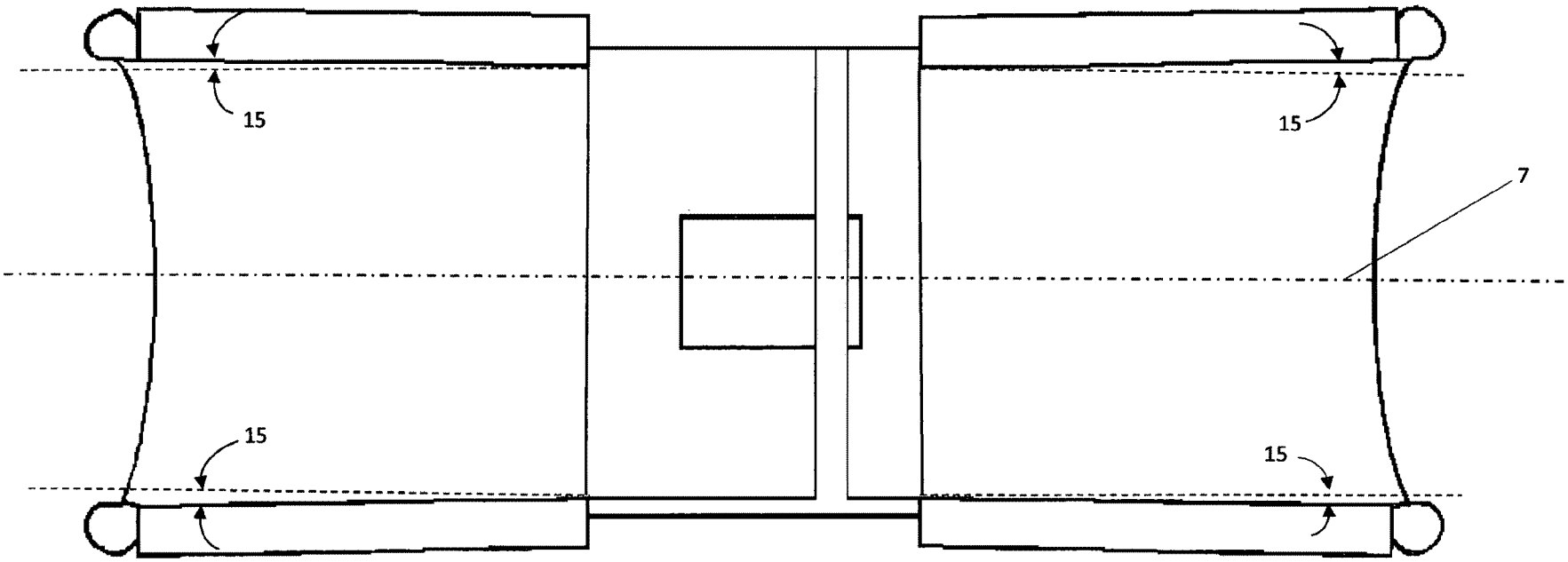
FIG. 3 shows a horizontal section through an embodiment of a ventilation apparatus with nozzles as described in this invention installed on both sides of a fan.

Referring now to FIG. 3, which shows a horizontal sectional view of an embodiment of this invention, it can be seen that the sidewalls of the throughbore diverge at an angle (15) with respect to lines parallel to the fan centreline (7). This underlines the non-cylindrical nature of the throughbore surface, and highlights the increase in flow area at the inlet and outlet planes (14).

Figure 4:
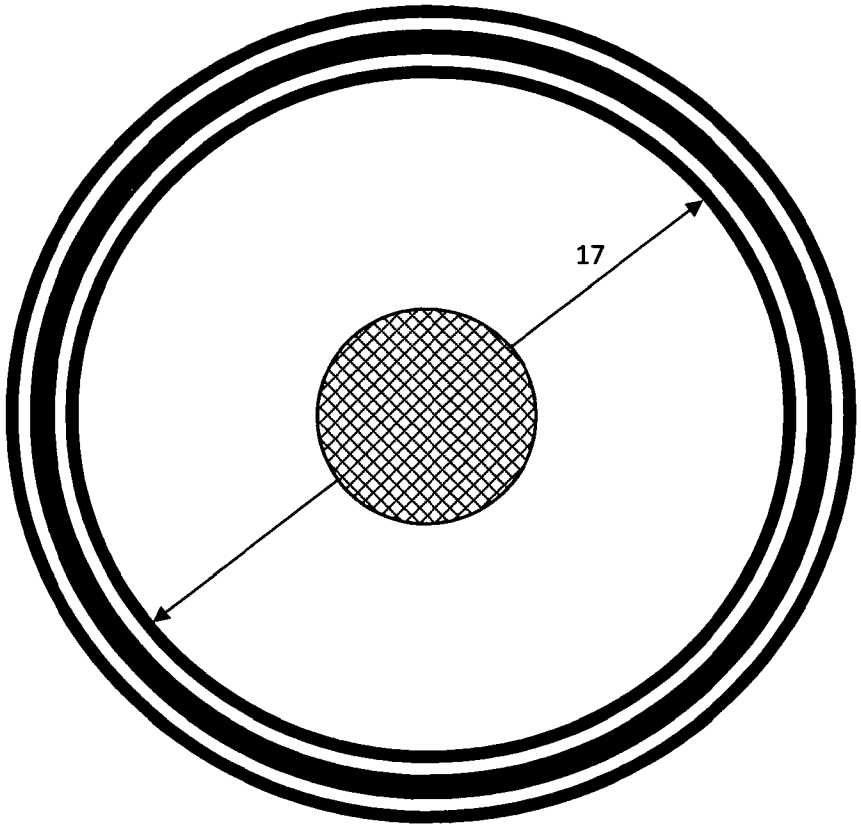
FIG. 4 shows an end view through an embodiment of a ventilation apparatus.

FIG. 4 shows an end view through an embodiment of a ventilation apparatus, with the edge of the nozzle throughbore at the distal end from the fan in the form of a circle with a specified diameter (17).

It would be possible to modify an existing fan assembly in order to fit nozzles as described in this invention to one or more sides of a fan, and hence reap the benefits of improved performance.

This invention is equally beneficial for the ventilation of tunnels, underground car parks and similar internal spaces.

It will be appreciated that the foregoing merely provides illustrations of embodiments and just some examples of their use. The skilled reader will readily understand that modifications can be made thereto without departing from the true scope of the inventions.

The invention claimed is:

1. A fan assembly for installation in an internal space to provide ventilation in the internal space, the fan assembly comprising:

a fan rotor for generating a ventilating flow, the inflow into the fan rotor being substantially parallel to the outflow from the fan rotor;

a nozzle throughbore having an edge which, in use, is in proximity to a surrounding surface in which the fan assembly is installed;

wherein:

the nozzle has a trailing edge at the distal end from the fan;

the fan assembly is arranged or arrangeable such that a ventilating flow generated by the fan will pass through the nozzle before exiting the assembly to enter a space to be ventilated;

a bellmouth extending from the nozzle trailing edge, wherein the angle made between the nozzle trailing edge and a centreline of the fan is not perpendicular;

the sidewalls of the nozzle throughbore diverge at an angle with respect to the fan centreline; and the nozzle trailing edge forms a circle.

2. A fan assembly according to claim 1, having a nozzle installed on each side of a fan.

3. A fan assembly according to claim 1, wherein the angle between the trailing edge and a line normal to the fan centreline is within the range of 5 to 60 degrees.

4. A fan assembly according to claim 1, wherein the cross-sectional area of the bellmouth throughbore decreases from the location of its attachment to the nozzle in the direction away from the fan, to a minimum cross-sectional area.

5. A fan assembly according to claim 2, wherein the bellmouth is rotationally symmetrical about its own central axis.

6. A fan assembly according to claim 2, wherein the bellmouth throughbore is arranged to be parallel to the shortest edge of the nozzle throughbore, at its point of attachment to the nozzle.

7. A fan assembly according to claim 2, wherein the bellmouth throughbore is arranged to form part of an elliptical arc at its point of attachment to the nozzle.

8. A fan assembly according to claim 2, wherein the bellmouth is arranged to form a part of an elliptical arc at the distal end from the fan.

9. A fan assembly according to claim 2 having two bellmouths, one installed on each side of the fan assembly.

* * * * *